US006695240B2

(12) United States Patent
Rajewski

(10) Patent No.: US 6,695,240 B2
(45) Date of Patent: Feb. 24, 2004

(54) SHREDDING APPARATUS

(75) Inventor: David E. Rajewski, Spokane, WA (US)

(73) Assignee: Shredfast, Inc., Airway Heights, WA (US)

( * ) Notice: Subject to any disclaimer, the term of this patent is extended or adjusted under 35 U.S.C. 154(b) by 0 days.

(21) Appl. No.: 09/854,681

(22) Filed: May 10, 2001

(65) Prior Publication Data

US 2002/0166911 A1 Nov. 14, 2002

(51) Int. Cl.[7] ..... B02C 18/16
(52) U.S. Cl. ..... 241/236; 241/295
(58) Field of Search ..... 241/236, 295

(56) References Cited

U.S. PATENT DOCUMENTS

| | | | | |
|---|---|---|---|---|
| 2,770,302 A | | 11/1956 | Lee | |
| 3,033,064 A | | 5/1962 | Lee | |
| 4,018,392 A | | 4/1977 | Wagner | |
| 4,565,330 A | | 1/1986 | Katoh | |
| 5,141,168 A | * | 8/1992 | Pepper | 241/236 |
| 5,292,078 A | | 3/1994 | Lodovico et al. | |
| 5,328,107 A | | 7/1994 | Tsai | |
| 6,168,104 B1 | | 1/2001 | Lin et al. | |

* cited by examiner

*Primary Examiner*—Mark Rosenbaum
(74) *Attorney, Agent, or Firm*—Wells St. John P.S.

(57) ABSTRACT

A shredding apparatus includes a frame and shafts driven to rotate about shaft axes. A plurality of cutter plates are mounted for rotation with the shafts and are arranged in radial overlapping fashion. The cutter plates may each include cutter tooth groups spaced about an outer plate parameter. A succession of cutting relief surfaces are disposed between successive cutter tooth groups. The cutter tooth groups may be disposed at least partially outward of associated relief surfaces in a radial direction with respect to the drive shaft axis.

16 Claims, 6 Drawing Sheets

SHREDDING APPARATUS

TECHNICAL FIELD

This invention pertains to shredding materials and particularly to knives used in shredding apparatus, preferably for use in shredding paper and other feed-stock.

BACKGROUND OF THE INVENTION

Rotary knife type shredders have been in use to shred paper and other material. One example of a mobile paper shredder is U.S. Pat. No. 5,542,617, issued to David E. Rajewski on Aug. 6, 1996, which is hereby incorporated by reference into this application as though fully set forth herein.

Shredders mounted within an enclosure may be provided in stationary work sites, or within trucks that have generally been referred to as mobile shredders because they can be moved from one location to another. Both forms may make use of shredding flails or knives, which are made to rotate in interleaved or intermeshing relation to a stator set of anvils or cutters, or another counter rotating set of hammers or knives. In either instance, prior forms of shredders may become clogged with product if the infeed is too aggressive.

Feed rate to shredder blades may be influenced by upstream feeding devices such as belts, augers, feed wheels or the like; or by the cutters themselves. Self feeding is inherent in cutter wheels with saw-type teeth in which the individual teeth have forwardly inclined hook angles. Forwardly hooked teeth tend to pull engaged materials further into the shredding cutters. If the materials to be shredded are abnormally dense, or of a tough consistency, the shredder may bog down or jam. This creates undesirable and inefficient down time for clearing the jam. Overloading also significantly reduces the useful life of the shredder drive components.

There is a need for a shredding system which provides cutters that will not easily bind and overload driving components.

There is also a need for a shredding cutter that is relatively simple in construction and inexpensive to produce.

The above needs are fulfilled as will be understood from the following description which, taken with the accompanying drawings and appended claims, describe the best mode currently known for carrying out the present invention.

BRIEF DESCRIPTION OF THE DRAWINGS

Preferred embodiments of the invention are described below with reference to the following accompanying drawings.

DESCRIPTION OF THE PREFERRED EMBODIMENTS

Figure 1:
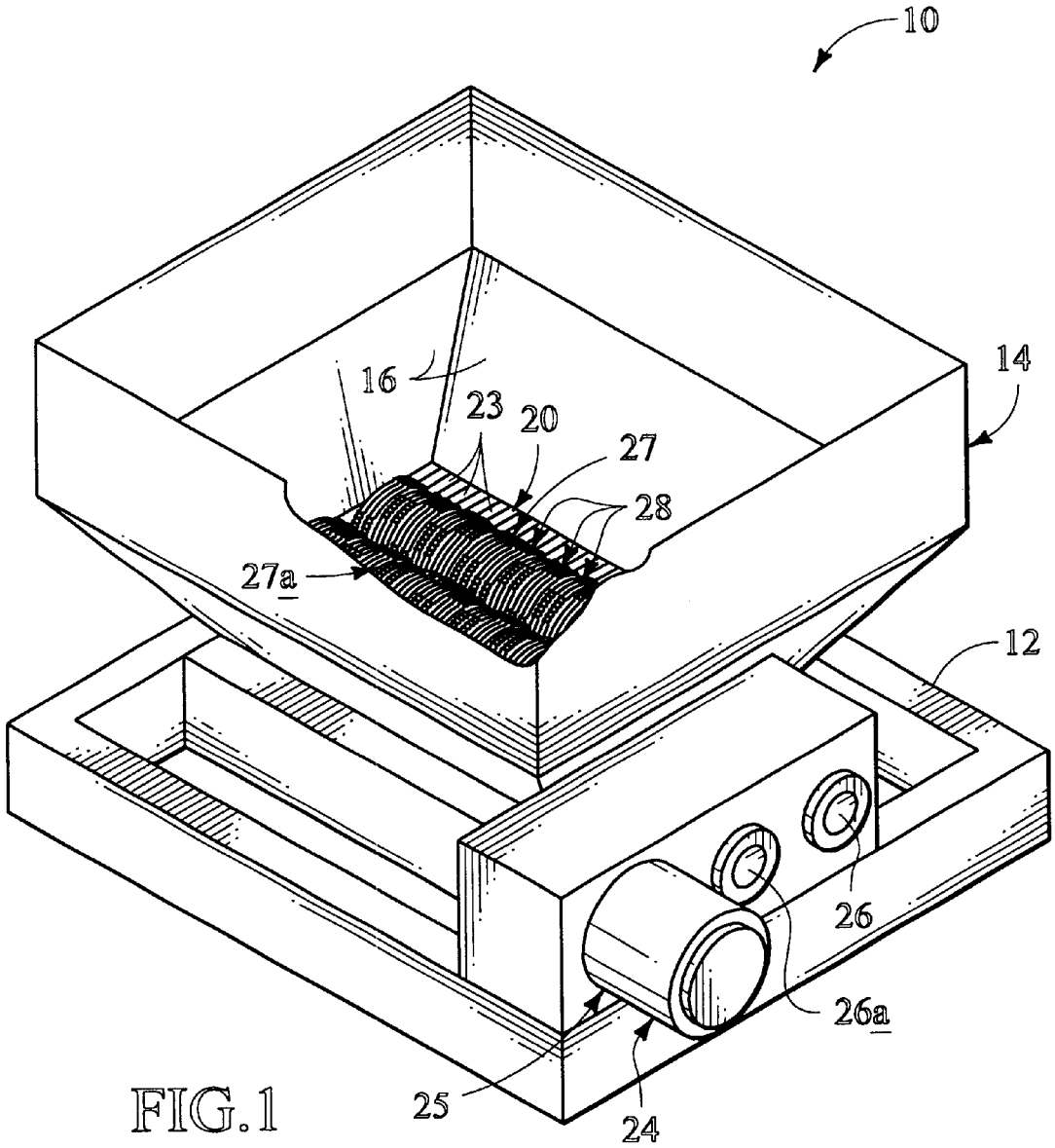
FIG. 1 is a perspective view of a shredding apparatus with portions broken away to show exemplary aspects of the invention.

Fasteners, materials, drive mechanisms, control circuitry, manufacturing and other means and components utilized to make and implement this invention are known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

General Description

Before describing details of preferred forms of the invention in detail, general descriptions of aspects of the invention will be given.

In one aspect of the invention, the shredding apparatus 10 includes a frame 12. A cutter drive 24 is provided with a drive shaft 26 mounted thereon for rotation about a drive shaft axis X. A first set of cutter plates 27 is mounted on the drive shaft 26 for rotation therewith. A second shaft **26*a* is also mounted to the frame for rotation about a second shaft axis Y. A second set of cutter plates 27*a* is mounted on the second shaft 26*a* for rotation therewith and is positioned in overlapping relationship with the first set of cutter plates 27. Each cutter plate 28 of both sets 27, 27*a* includes an outer perimeter 30 formed about the associated drive shaft axis X and second shaft axis Y. Cutter tooth groups 32 are spaced about the outer perimeter of each cutter plate 28, and cutting relief surfaces 34 are disposed between successive cutter tooth groups. The cutter tooth groups 32 are disposed on each cutter plate 28 at least partially outward of the cutting relief surfaces 34** in a radial direction with respect to the associated axis.

In another aspect, a cutter plate 28 is provided within a shredding apparatus 10. The cutter plate includes a cutter plate body 36 with a shaft mount 38 substantially centered on an axis (X or Y). An outer perimeter 30 is formed about the axis (X or Y), and cutter tooth groups 32 are spaced thereabout. Cutting relief surfaces 34 are provided along the outer perimeter 30. The surfaces 34 are disposed between successive cutter tooth groups 32. The cutter tooth groups 32 project outward in a radial direction with respect to the axis (X or Y).

A further aspect of the invention includes a shredding apparatus cutter plate 28 which comprises a cutter plate body 36 with a shaft mount 38 for releasable attachment to a shaft (26 or **26*a*) for rotation therewith about an axis (X or Y). An outer perimeter 30 formed about the axis (X or Y) and cutter tooth groups 32 are formed integrally with the cutter plate body 36 at spacing that is approximately equiangular about the outer perimeter. A succession of cutting relief surfaces 34 are formed as arcs with approximate centers at the axis (X or Y). The cutting relief surfaces 34 are disposed between successive cutter tooth groups 32. The cutter tooth groups 32 project radially outward with respect to the axis (X or Y) from the cutting relief surfaces. Each cutter tooth group is comprised of a number of individual cutter teeth 42 and at least some of the cutter teeth 42 are substantially triangular in configuration. Each tooth 42 includes a base 44 along the cutter plate. The base 44 is spaced from the shaft axis (X or Y) by a distance substantially equal to radial spacing from the shaft axis (X or Y) to the cutting relief surfaces 34**.

In a further aspect the shredding apparatus 10 includes a frame 12 and a cutter drive 24 including a drive shaft 26 and a second shaft 26*a*, located adjacent a shredding station 20 for rotation in opposed directions about shaft axes X and Y. A first set of cutter plates 27 is mounted on the first drive shaft 26 for rotation therewith. A second set of cutter plates 26*a* are mounted on the second drive shaft 26*a* for rotation therewith and in axial interleaved relation with the first set of cutter plates 27. Each individual cutter plate 28 includes an outer perimeter 30 formed about the associated shaft axis (X or Y). Cutter tooth groups 32 and cutting relief surfaces 34 are spaced about the outer perimeters of at least some of the cutter plates. The cutter tooth groups 32 are angularly disposed about the associated axis (X or Y) such that a cutter tooth 42 on one cutter plate 28 is in approximate axial alignment with a cutting relief surface 34 on another cutter plate 28 that is mounted to the same shaft 26 or 26*a*.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

FIG. 1 illustrates a shredding apparatus 10 including exemplary aspects of the invention. The apparatus 10 may be used to shred paper and other feedstock either from a stationary location or from a support platform on a movable vehicle.

In one preferred form, the apparatus includes an input hopper 14 with an infeed end 18 and side walls 16 or other guide surface leading to a shredding station 20. Paper and other feedstock material may be manually or mechanically fed into the input hopper 14 in any one of a number known of ways, with no one in particular being required to practice this invention. It is pointed out that the apparatus may be provided with or without a hopper or other form of feed mechanism, and that different known forms of feeding arrangements may be used.

From the above, it may be understood that the term "feed" or "input hopper" as used herein is broader than its typical meaning, and without limitation, includes hoppers and any other temporary storage or containment structure for receiving the feedstock material to be shredded and for delivering the feedstock to the shredding station. Thus, the hopper may include the stationary walls 16 substantially as shown, or the walls might be defined by another form of material moving hopper construction that may directly or indirectly provide the feedstock material to the feedstock handling system for feeding to the shredder.

FIG. 1 illustrates the shredding system 10 with the exemplary hopper construction in which material is placed in the infeed 18 and is delivered to the shredding station 20 where the material may be shredded by operation of cutters and the cutter drive generally described above and described by example below.

To provide driving energy for operation, an appropriate engine or motor may be supplied and coupled to a transmission or other appropriate drive arrangement as the cutter drive 24. The cutter drive 24 may be mounted to a stationary support surface in applications where the shredder is to be used in, say a permanent shredding facility. Alternatively, the drive 24 may be mounted with the shredder apparatus connected to a vehicle power source. Such a drive arrangement could be a form of power take off or other power transmission arrangement known in the art, that makes use of an associated vehicle engine or motor for driving energy.

In the illustrated example, a motor and transmission arrangement 25 is provided on the frame 12 to rotate the drive shaft 26 and the second shaft 26*a*. It is preferred that the shafts 26, 26*a* be rotated by the drive in opposed directions. It is preferable that the axes X, Y of the drive shaft 26 and second shaft 26*a* be parallel.

Feedstock being fed into the hopper 14 may be more than might otherwise be easily or efficiently shredded by other known forms of shredding equipment. However, with the present shredding components, excess material may remain in the hopper during operation of the cutting plates and eventually be shredded without causing bogging or overloading of the drive equipment. This is a function of the plate construction and arrangement described below.

Feedstock passing through the hopper is directed to the shredding station 20 where it encounters cutter plates 28. The cutter plates function to shred and discharge the material at a discharge station 21. The shredded material may drop by gravity or be otherwise collected at the discharge station 21 for further processing.

Reference will now be made to FIGS. 3–9 for further description of the exemplary cutter plates 28. Individual cutter plates 28 are preferably substantially circular in configuration and are formed of a hard, preferably metallic material such as tool steel using known metal forming processes and apparatus.

Figure 3:
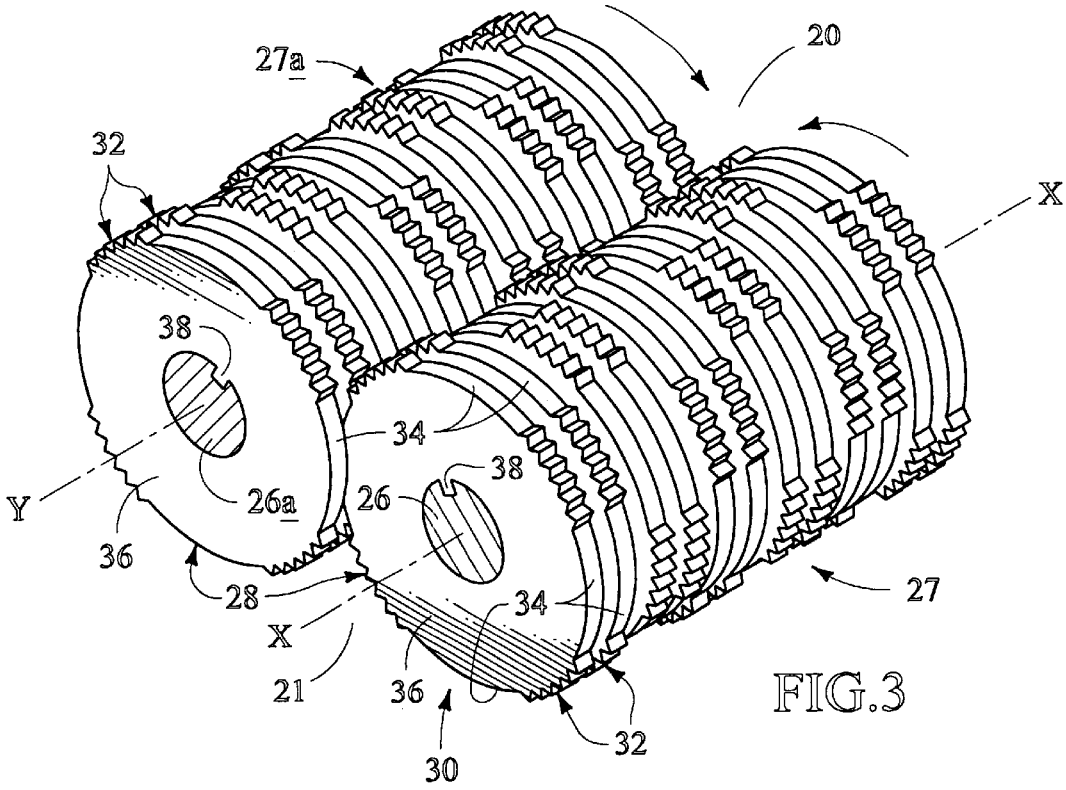
FIG. 3 is a fragmented detail view showing an exemplary arrangement of cutter teeth on one plate and another set of cutter teeth on an adjacent plate.

It may be noted in FIG. 3 that a number of individual cutter plates 28 may be mounted in axially spaced relation along the drive shaft 26 and second shaft 26*a*. Appropriate spacers in the form of washers (not shown) may be provided for spacing purposes, or other appropriate spacing apparatus or technique may be used.

That is, the plates 28 comprising the first set 27 may be mounted on the drive shaft 26, and the second set 27*a* of cutter plates may be mounted on the second shaft 26*a* in interleaved, radially overlapping relation substantially as shown.

The cutter plates may be provided with an appropriate form of interlock arrangement or drive shaft mount 38 by which the individual plate will rotate in direct response to rotation of the associated shaft 26 or 26*a*. In the illustrated example, each shaft 26, 26*a* successive plates 28 using key arrangements by which the plates are locked for rotation with the respective shafts in a conventional manner. Other equivalent shaft mount or locking arrangements might also be used to secure the shafts and plates for mutual rotation.

It may be noted that axial spaces are provided in the illustrated examples between successive cutter plates 28. The amount of axial space between adjacent plates on the shaft 26 may be just slightly more than the axial thickness dimension of the individual plates. This spacing allows for stationary fingers 23 which may be provided on the frame 12 to project between successive plates 28, spacing the plates apart and presenting relatively stationary edges against which feedstock may rest. The finger/spacer arrangements may be of a conventional form used in other known rotating shredding plate shredders.

In preferred forms, and as shown, a pair of shafts with meshing or interleaved sets 27, 27*a* of otherwise substantially identical cutter plates may be used in a manner similar to the example shown in FIG. 3. In the examples illustrated, two sets of cutter plates are mounted, one set to each of two shafts 26, 26*a* that are driven to rotate by the drive 24. The shafts may be rotatably mounted by appropriate commercially known bearings to the framework and located at or at least adjacent to the bottom end of the infeed hopper 14. Fingers 23 may also be used in this configuration, between adjacent cutter plates on each shaft.

It is preferable also that the plates of the two sets partially overlap one another, as indicated by examples shown in FIGS. 6–10. An exemplary amount of radial overlap D (FIG. 6), say approximately 0.25 inches is generally indicated although other spacing might be used.

Figure 4:
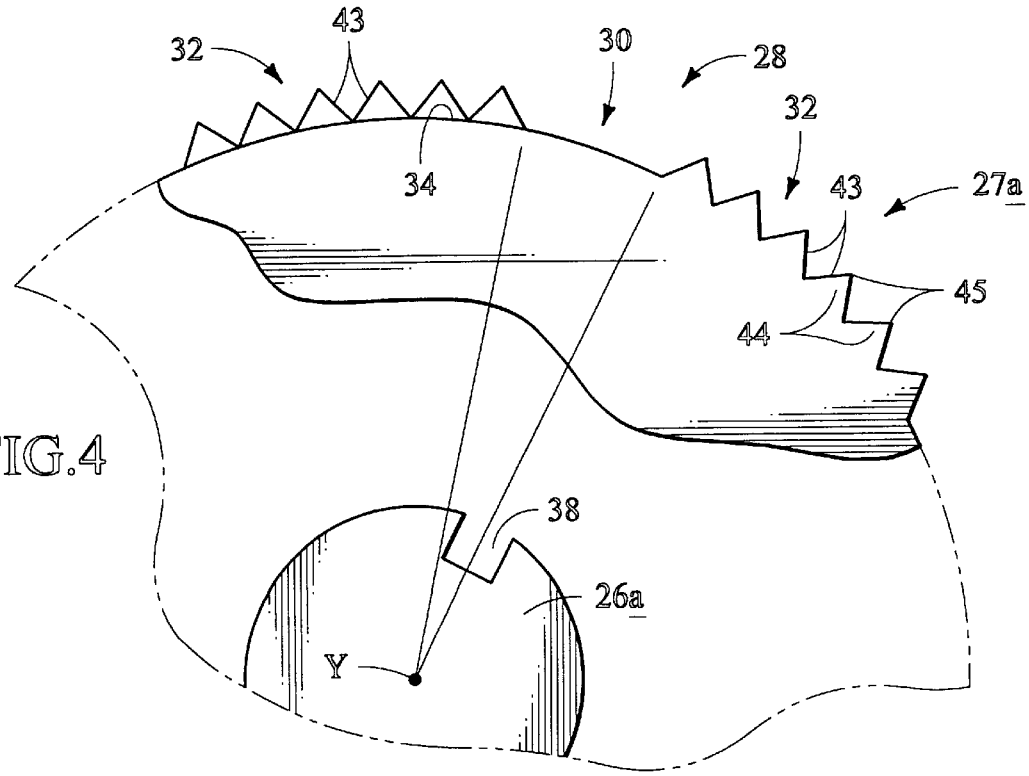
FIG. 4 is a perspective view of two sets of cutter teeth.
Figure 5:
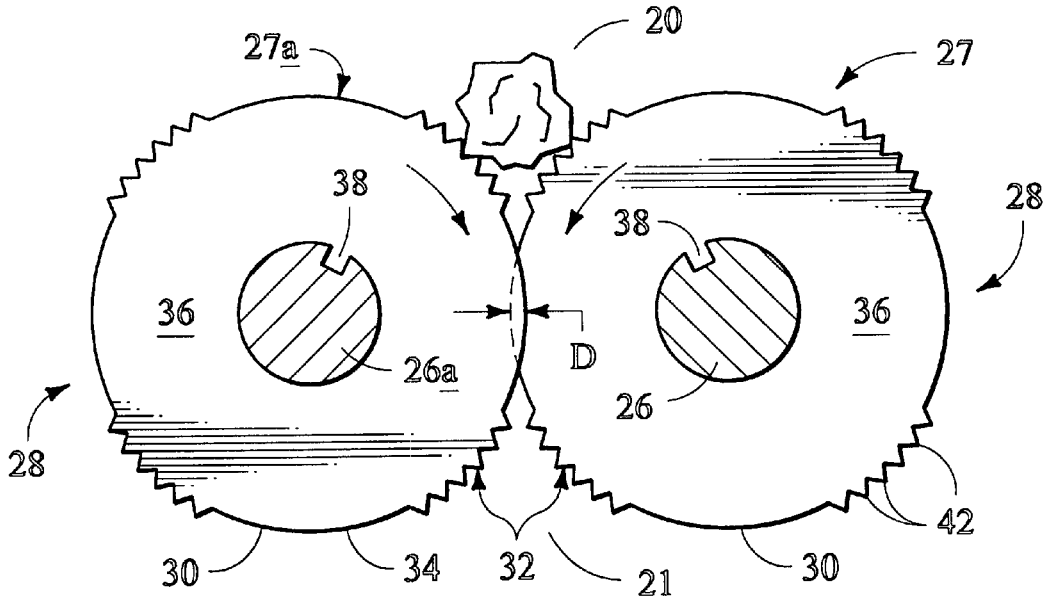
FIGS. 5–9 are sequential views showing rotation of a pair of cutter plates during operation and progress of feedstock between the plates.
Figure 6:
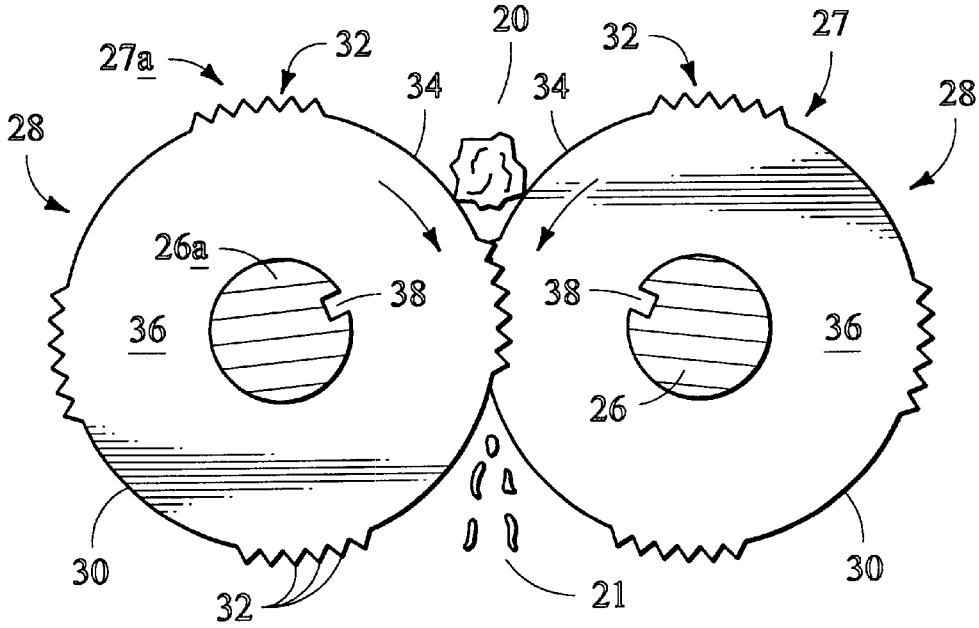
Figure 7:
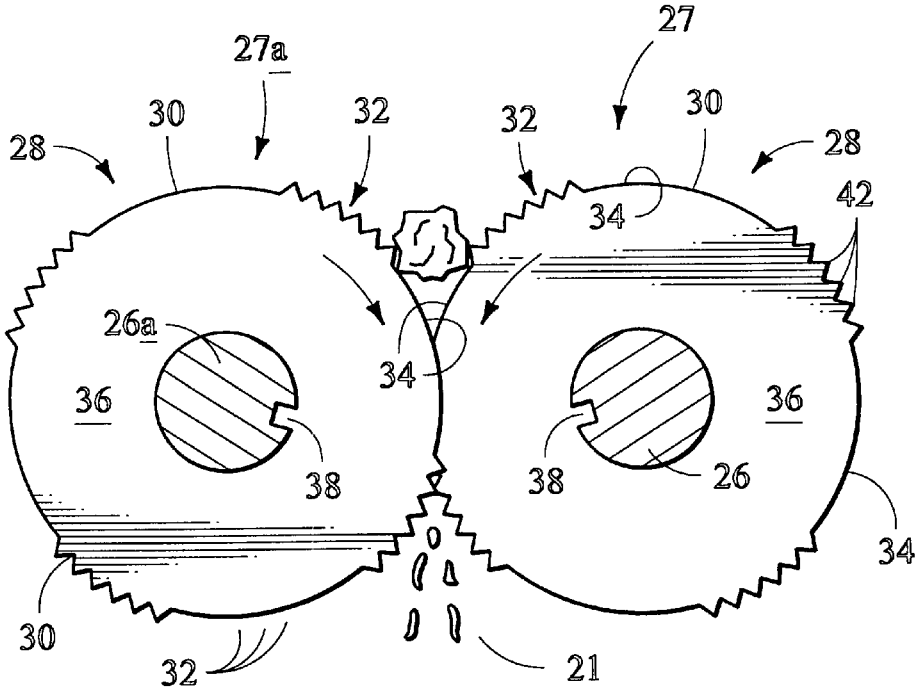
Figure 8:
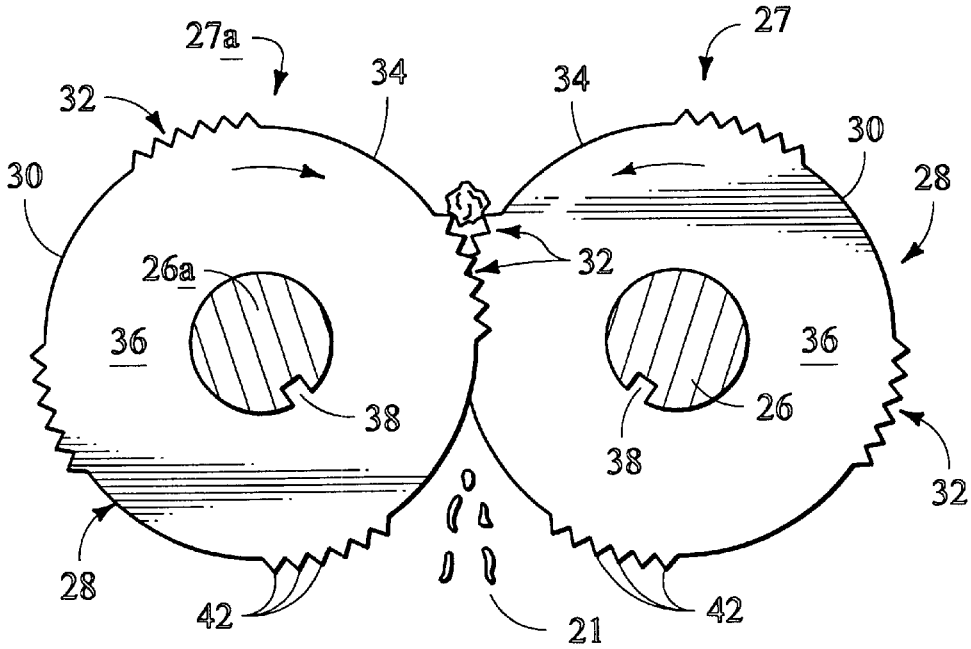
Figure 9:
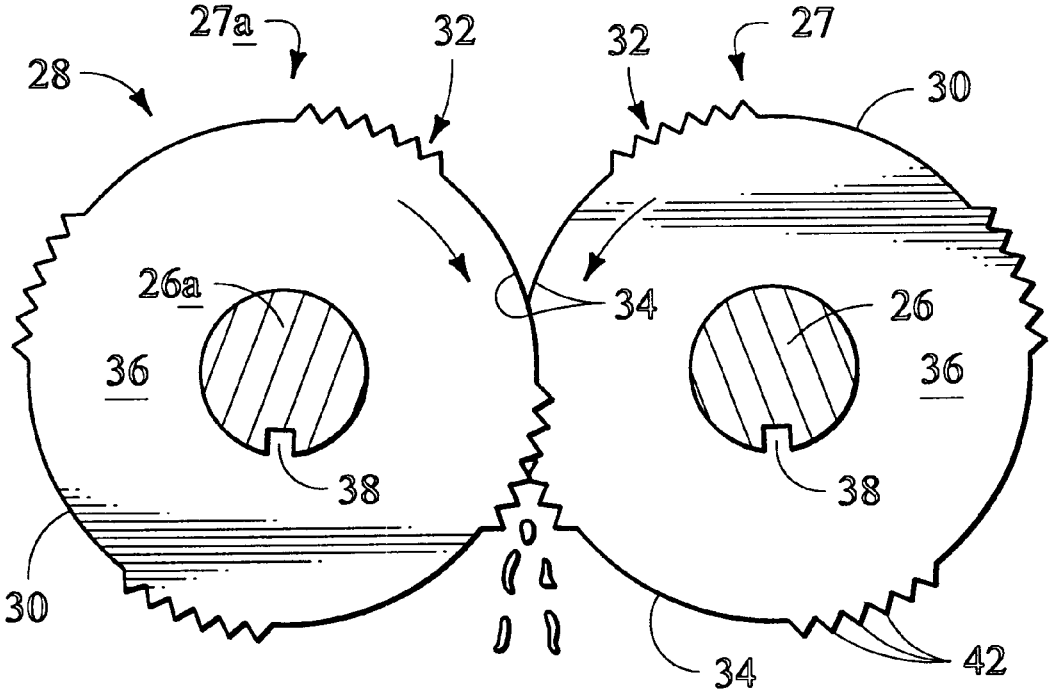

FIGS. 3 and 4 are illustrative of a preferred form of plate in which four cutter tooth groups 32 are spaced about each plate, with interspersed cutting relief surfaces 34 completing the plate perimeter. Other numbers of cutter tooth groups 32 could be used, but it is preferable that for plate balance and arrangement of successive plates on a shaft, that the selected number of cutter tooth groups 32 be equiangularly spaced about the associated drive shaft or central plate axis.

It is noted that the term "relief surface" may include the exemplary surface configuration shown and described below. However other configurations may be used as cutting relief surfaces 34 between the cutter tooth groups. Equivalent surfaces 34 could include but not be limited to smooth or undulating curvilinear surfaces, smooth or undulating rectilinear surfaces, or combinations of both configurations could also be used, so long as the intent of providing cutting relief between successive cutter tooth groups is met. That is to say it is preferable that the feedstock be intermittently pulled and shredded by the cutter tooth groups, and that no or little cutting or shredding activity be produced when the feedstock encounters the cutting relief surfaces 34.

In the illustrated examples the relief surfaces 34 be arcuate, and centered on the plate axis, and the individual teeth 42 are disposed outwardly in a radial direction from the surfaces 34. Thus the exemplary cutting relief surfaces 34 are not operatively positioned in a radial orientation to become aggressive shearing elements during operation of the apparatus, nor are the smooth external arcuate surfaces 34 conducive to shredding.

Providing the intermittent cutting relief surfaces benefits operation of the shredding apparatus. The surfaces 34 reduce the aggressive natural tendency for the teeth to pull material into the space between the oppositely rotating sets of cutter plates. Thus the cutter plates are not all in a shredding mode at all times during rotation of the shafts, but instead take intermittent "bites" from the feedstock material as the shafts rotate. It has been found that this approach significantly reduces jamming or blockage of the shredder from overloading with dense material, and significantly improves the capacity to quickly and effectively shred dense materials such as telephone books.

It is noted that the groups 32 of teeth may be made up of substantially similar triangular individual tooth configurations. In the preferred example shown, groups of six teeth 42 are provided in each of four groups. Spacing of the cutter tooth groups is preferably equiangular about the associated shaft axis, and the percentile of the cutter plate perimeter 30 occupied by cutter teeth is preferably within a range of approximately 15% and 25%.

Each tooth 42 as exemplified may include a pair of converging sides 43 that lead from a base 44 to a point 45. One preferred tooth shape, shown best in FIG. 4, is in the form of an isosceles triangle with sides 43 being equal. Other tooth configurations may also be used.

In the illustrated exemplary tooth configurations, it is preferable that the base 44 of each tooth configuration be spaced from the associated plate center axis (X or Y) by distances substantially equal to the spacing from the centers to the associated cutting relief surfaces 34. The preferred cutting relief surfaces are thus spaced radially inward from the tooth points 45 to provide a non or minimal shredding surface between successive sets of shredding teeth.

The preferred form of plate includes cutter teeth that are integral with the plate bodies 36. However, it is possible to provide cutter plates with tooth inserts formed of another material such as carbide for extended wear. While the cutter tooth groups are shown with six cutter teeth each, it is also possible for more or fewer numbers to be used so long as relief surfaces 34 are provided between the groups.

Note is made with respect to FIGS. 3 and 4 where successive pairs of cutter plates 28 are shown mounted to drive shafts 26, 26*a*. The pairs of plates on one shaft 26 may be substantially mirror images of plate pairs on the opposite shaft 26*a*.

The cutter tooth groups may best be disposed in direct opposition so as to pass in a scissors like shredding action past one another during rotation, as may be noted by following the rotation sequence in FIGS. 6–9. The shredding action is immediately followed by a no or minimal shredding action as opposed cutting relief surfaces 34 pass one another. Thus the plates operate in a sequence of shredding and non shredding actions that avoid overloading by taking small but frequent "bites" of the feedstock during operation.

It is preferable that a sequence of plate pairs be offset angularly along the shafts, so that not all the cutter tooth groups 34 on a drive shaft are in axial alignment. This arrangement may be understood with reference to FIGS. 4 In preferred forms, cutter tooth groups on one plate may be spaced angularly from cutter tooth groups on an adjacent plate. Thus the relief surfaces 34 on one plate may be approximately axially aligned with adjacent tooth groups on other plates along the same shaft 26, 26*a*. This further enhances the sporadic shredding action and minimizes the chance of jamming during operation.

It is preferred that the shafts be rotated in opposed directions in order to engage and shred materials received in the hopper. Appropriate known forms of gearing or other drive transmission may be provided for this purpose. The shafts preferably rotate in the direction indicated in FIG. 6, so that feedstock in the hopper is engaged as indicated above and progressively shredded between successive cutter plates 28.

Figure 2:
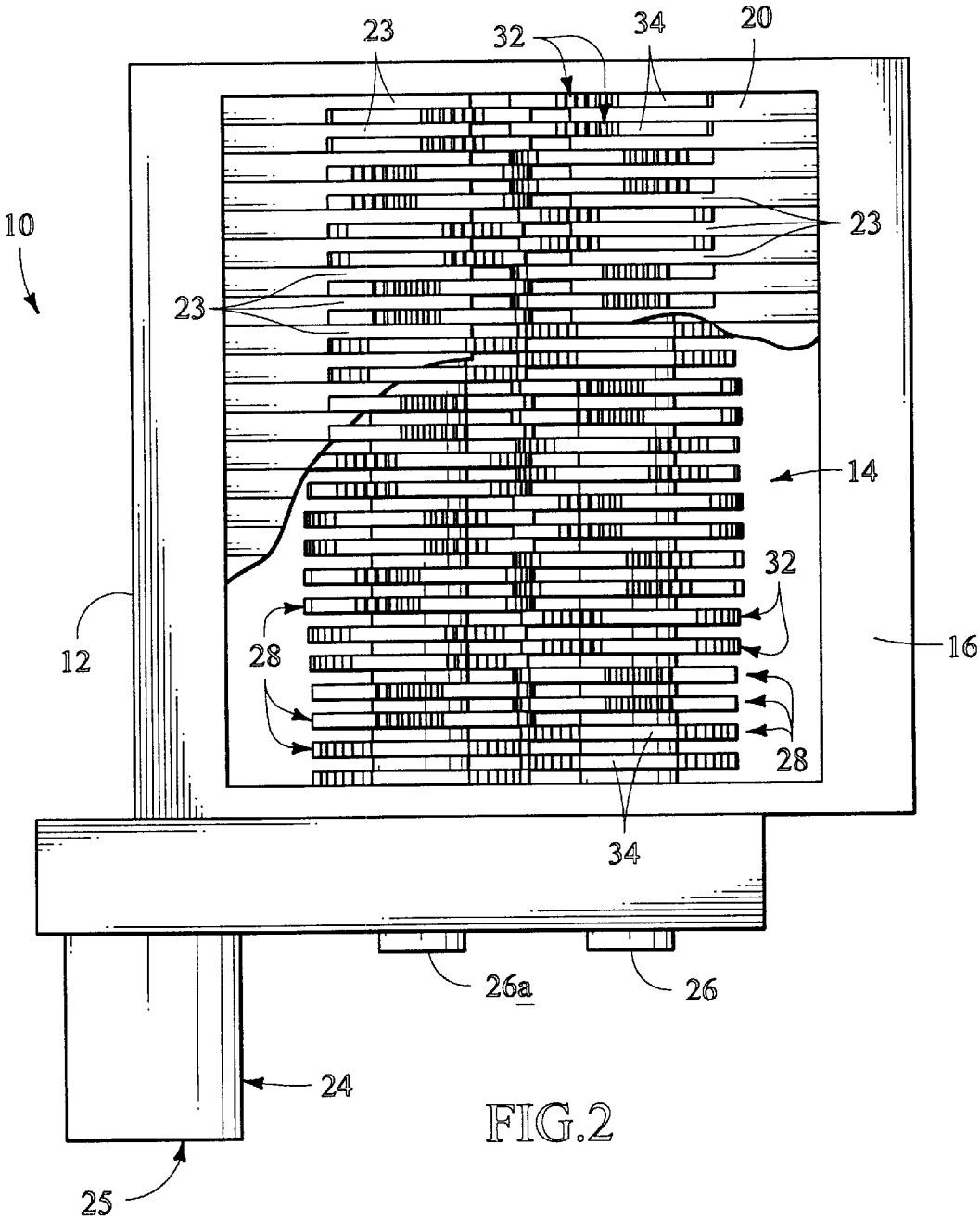
FIG. 2 is a top plan schematic view of a number of the cutters mounted to parallel shafts and arranged on substantially parallel drive shafts to intermesh in operation.

While there are many different drive gearing and other arrangements which may be used to provide the rotation to the drive shafts 26, no one in particular is required to practice the invention. The preferred arrangement generally shown in FIGS. 1 and 2 are merely one example within the contemplation of this invention. Whatever form of drive is used, it may be preferred to rotate the drive shafts at speeds greater than previously thought capable in other shredders. In one example, a preferred operating rpm may be approximately 64 rpm, which is significantly higher than other shredders due to the capability of the cutter plates to operate without clogging.

In operation, feedstock is deposited into the hopper following actuation of the drive to initiate rotation of the drive shafts 26 26*a* and the cutter plates mounted thereon. Feedstock is directed toward the rotating cutter plates and is sporadically engaged by the cutter tooth groups as the shafts rotate. The cutter teeth shear and shred the engaged material against one another in a rapid but broken sequence so that no binding or jamming of the cutters is likely to occur. Thus the rotating cutters will shred the feedstock progressively and discharge the shredded material out the bottom of the apparatus where it may be collected for further handling.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A shredding apparatus, comprising:

a frame;

a cutter drive on the frame including a drive shaft mounted to the frame for rotation about a drive shaft axis;

a first set of cutter plates mounted on the drive shaft for rotation therewith;

a second shaft mounted to the frame for rotation about a second shaft axis;

a second set of cutter plates mounted on the second shaft for rotation therewith and positioned in overlapping relationship with the first set of cutter plates;

wherein each cutter plate includes an outer perimeter formed about the associated drive shaft axis and second shaft axis;

cutter tooth groups spaced about the outer perimeter of each cutter plate;

cutting relief surfaces disposed between successive cutter tooth groups on each cutter plate; and wherein the cutter tooth groups are disposed on each cutter plate at least partially outward of the cutting relief surfaces in a radial direction with respect to an associated shaft axis.

2. The shredding apparatus of claim 1 wherein the cutter plates on each shaft are arranged in a pattern, such that one tooth group on one cutter plate is angularly disposed about the associated shaft from another tooth group on another cutter plate mounted to the same shaft.

3. The shredding apparatus of claim 1 wherein the tooth cutter groups are comprised of individual cutter teeth, each of which being substantially triangular in configuration with two substantially equiangular sides and a base that is joined with the cutter plate.

4. The shredding apparatus of claim 1 wherein the tooth cutter groups are comprised of individual cutter teeth of triangular configuration;

wherein each tooth includes a base and a point radially outward of the base; and wherein the cutting relief surfaces and tooth bases are approximately equally spaced radially from the drive shaft axis.

5. The shredding apparatus of claim 1 wherein the tooth cutter groups are comprised of individual cutter teeth, each of which being substantially triangular in configuration with two substantially equiangular sides.

6. The shredding apparatus of claim 1 wherein the tooth cutter groups occupy a range of approximately 15% and 25% of the outer perimeter of each cutter plate.

7. The shredding apparatus of claim 1 wherein the drive operates the drive shaft to rotate within a range of approximately 34 to 68 rpm.

8. The shredding apparatus of claim 1 wherein the second shaft is a drive shaft that is connected to the cutter drive.

9. The shredding apparatus of claim 1, wherein cutter tooth groups which are associated with the cutter plates on the drive shaft, are rotatable into axial juxtaposition with cutter tooth groups which are associated with the cutter plates on the second shaft.

10. The shredding apparatus of claim 1 wherein the drive shaft and the second shaft are driven to rotate in opposite directions, and wherein the cutting relief surfaces on the cutter plates mounted to the drive shaft partially radially overlap the cutting relief surfaces on the second shaft.

11. The shredding apparatus of claim 1 wherein the cutting relief surfaces are semi-circular and at substantially equal radii from the respective drive shaft and second shaft axes.

12. The shredding apparatus of claim 1 wherein the cutting relief surfaces are semi-circular and at substantially equal radii from the respective drive shaft and second shaft axes; and wherein the cutter tooth groups are comprised of individual, substantially identical cutter teeth each of which being substantially triangular.

13. The shredding apparatus of claim 1 wherein the cutting relief surfaces are at substantially equal radii from the respective drive shaft axis and second shaft axis; and wherein the cutter tooth groups are comprised of individual cutter teeth, each tooth being substantially triangular in configuration with two substantially equal length sides and a base that is integral with the associated cutter plate.

14. In a shredding apparatus, a cutter plate, comprising:

a cutter plate body including a shaft mount substantially centered on an axis;

an outer perimeter formed about the axis;

cutter tooth group spaced about the outer perimeter;

cutting relief surfaces alone the outer perimeter and disposed between successive cutter tooth groups; and wherein the cutter tooth groups project outward in a radial direction with respect to the axis; and wherein the cutting relief surfaces are semi-circular and at substantially equal radii from the axis.

15. The cutter plate of claim 14 wherein the cutting relief surfaces are semi-circular and at substantially equal radii from the axis; and wherein the cutter tooth groups are comprised of individual, substantially identical cutter teeth each of which being substantially triangular in configuration with two substantially equal length sides and a base that is integral with the associated cutter plate.

16. A shredding apparatus cutter plate, comprising:

a cutter plate body including a shaft mount for releasable attachment to a shaft for rotation therewith about an axis;

an outer perimeter formed about the axis;

cutter tooth groups formed integrally with the cutter plate body and spaced approximately equiangularly about the outer perimeter;

a succession of cutting relief surfaces formed as arcs with approximate centers at the axis, the cutting relief surfaces being disposed between successive cutter tooth groups;

wherein the cutter tooth groups project radially outward with respect to the drive shaft axis from the cutting relief surfaces;

wherein each cutter tooth group is comprised of a number of individual cutter teeth; and at least some of the cutter teeth being substantially triangular in configuration, each having a base along the cutter plate and spaced from the axis by a distance substantially equal to radial spacing from the axis to the cutting relief surfaces.

* * * * *

UNITED STATES PATENT AND TRADEMARK OFFICE

CERTIFICATE OF CORRECTION

PATENT NO. : 6,695,240 B2
DATED : February 24, 2004
INVENTOR(S) : Rajewski

It is certified that error appears in the above-identified patent and that said Letters Patent is hereby corrected as shown below:

Column 8,
Line 30, replace "cutting relief surfaces alone the outer perimeter and" with -- cutting relief surfaces along the outer perimeter and --

Signed and Sealed this

Third Day of August, 2004

JON W. DUDAS
*Acting Director of the United States Patent and Trademark Office*